US009936288B2

(12) United States Patent
Akino

(10) Patent No.: US 9,936,288 B2
(45) Date of Patent: Apr. 3, 2018

(54) NARROW-ANGLE DIRECTIONAL MICROPHONE AND METHOD OF MANUFACTURING THE SAME

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-shi, Tokyo (JP)

( * ) Notice: Subject to any disclaimer, the term of this patent is extended or adjusted under 35 U.S.C. 154(b) by 127 days.

(21) Appl. No.: 15/061,226

(22) Filed: Mar. 4, 2016

(65) Prior Publication Data

US 2016/0269821 A1 Sep. 15, 2016

(30) Foreign Application Priority Data

Mar. 11, 2015 (JP) ..... 2015-048094

(51) Int. Cl.
*H04R 1/34* (2006.01)
*H04R 31/00* (2006.01)
*H04R 1/02* (2006.01)

(52) U.S. Cl.
CPC ..... *H04R 1/342* (2013.01); *H04R 31/006* (2013.01); *H04R 1/021* (2013.01)

(58) Field of Classification Search
None
See application file for complete search history.

(56) References Cited

U.S. PATENT DOCUMENTS 4,600,077 A * 7/1986 Drever ..... H04R 1/086 181/158
4,757,546 A * 7/1988 Akino ..... H04R 1/342 381/357
4,789,044 A * 12/1988 Akino ..... H04R 1/38 181/158
6,418,229 B1 * 7/2002 Staat ..... H04R 1/326 181/158

(Continued)

FOREIGN PATENT DOCUMENTS

JP 2562295 B2 12/1996

*Primary Examiner* — Matthew Eason
*Assistant Examiner* — Taunya McCarty
(74) *Attorney, Agent, or Firm* — Manabu Kanesaka

(57) ABSTRACT

Excellent narrow-angle directivity is obtained by causing a microphone case main body to function as an acoustic tube, reducing a weight of a microphone, and suppressing leakage of sound waves from an inside of the acoustic tube to an outside. An acoustic tube microphone case includes a microphone case main body made of a metal tube having a plurality of openings formed in a peripheral surface, and acoustic resistance materials formed in a rectangular sheet manner, cylindrically rounded such that both right and left ends are mutually in contact, and arranged along an inner peripheral surface of the microphone case main body. A plurality of the acoustic resistance materials is layered, and at least the innermost acoustic resistance material applies a force in a developing direction by an elastic force thereof, and presses the outside acoustic resistance materials against the inner peripheral surface of the microphone case main body.

8 Claims, 7 Drawing Sheets

(56) References Cited

U.S. PATENT DOCUMENTS

| | | | | |
|---|---|---|---|---|
| 7,623,671 | B2 * | 11/2009 | Akino | H04R 1/086<br>381/356 |
| 7,751,582 | B2 * | 7/2010 | Akino | H04R 1/342<br>381/337 |
| 7,848,535 | B2 * | 12/2010 | Akino | H04R 1/326<br>381/338 |
| 8,306,251 | B2 * | 11/2012 | Akino | H04R 1/083<br>381/355 |
| 8,325,960 | B2 * | 12/2012 | Akino | H04R 1/083<br>381/355 |
| 8,331,600 | B2 * | 12/2012 | Suzuki | H04R 1/342<br>381/360 |
| 8,948,433 | B2 * | 2/2015 | Akino | H04R 1/025<br>381/356 |
| 8,983,106 | B2 * | 3/2015 | Akino | H04R 9/08<br>381/356 |

* cited by examiner

NARROW-ANGLE DIRECTIONAL MICROPHONE AND METHOD OF MANUFACTURING THE SAME

BACKGROUND OF THE INVENTION

1. Field of the Invention

The present invention relates to a narrow-angle directional microphone and a method of manufacturing the same, and specifically relates to a narrow-angle directional microphone using an acoustic tube and a method of manufacturing the same.

2. Description of the Related Art

In narrow-angle directional microphones having an acoustic tube, a front acoustic terminal of a microphone unit and a rear end of the acoustic tube are connected and a connected portion is sealed so that external sound waves do not enter through the connection portion. Such a configuration realizes significantly narrow directivity. However, there are drawbacks of easily catching external wind noise and a high proximity effect to distort sound in a low frequency range when a sound source is close.

As a configuration to solve the above-described drawbacks, the applicant of the present application discloses, in Japanese Patent No. 2562295, a configuration to provide a plurality of openings (sound wave introduction ports) in a tube wall of an acoustic tube (aluminum tube) that accommodates a microphone unit, and to stick acoustic resistances (fabric, non-woven fabric, or the like) to outside portions of the openings.

The configuration disclosed in Japanese Patent No. 2562295 can have lower wind noise and proximity effect than conventional narrow-angle directional microphones.

By the way, as illustrated in FIG. 8, an acoustic tube 50 in which an acoustic resistance material 52 is stuck to openings 51 is covered with a microphone case 55 having openings 56 outside to mechanically protect the acoustic tube 50 and form electrostatic shield. However, typically, the microphone case 55 is also formed of aluminum, and thus there is a problem of an increase in weight as the entire narrow-angle directional microphone.

As a method to solve the problem, use of the microphone case as the acoustic tube can be considered. In that case, the microphone case is provided with a plurality of acoustic passage openings, and a mesh-like acoustic resistance material made of a sheet-like conductive material is stuck to an inside of the case. A configuration to block the openings with the acoustic resistance material is used. The reason to form the acoustic resistance material with the conductive material is to configure the electrostatic shield. Accordingly, the microphone case also serves as the acoustic tube, and thus the weight as the entire microphone becomes lighter.

However, an adhesive is applied to an inside surface of the microphone case, and the sheet-like acoustic resistance material is stuck. Therefore, there is a problem that difficulty in processing is high. Further, there is a problem that acoustic characteristics are deteriorated when contact failure occurs.

To solve the above-described problems, as a result of diligent examination, the applicant of the present application has found a method for allowing the acoustic resistance to be closely attached to the opening of the microphone case with a force of a cylinder to develop, which cylinder is prepared by rounding an elastic acoustic resistance sheet and inserted into the microphone case to inscribe thereto. In this case, as illustrated in FIG. 9 (sectional view), a sheet-like acoustic resistance material 61 is accommodated in a microphone case 62 in a state of being cylindrically rounded such that both right and left ends of the sheet-like acoustic resistance material 61 are in contact.

However, there is a small difference between a diameter of the cylindrical acoustic resistance material 61 and an inner diameter of the microphone case 62, and thus the cross section of the cylindrical acoustic resistance material 61 is not a perfect circle. Therefore, even if opening portions 63 of the microphone case 62 can be covered with the acoustic resistance material 61, there is a possibility that gaps 70 (thin air layers) are formed between the acoustic resistance material 61 and inner surface of the microphone case 62. If there are such gaps, an acoustic resistance value is decreased (the gaps are equivalent to a case where the openings of the microphone case become larger). Therefore, there is a problem that sound waves inside the acoustic tube leak.

SUMMARY OF THE INVENTION

The present invention has been made focusing on the above-described points, and an objective of the present invention is to provide a narrow-angle directional microphone and a method of manufacturing the same that can achieve excellent narrow-angle directivity by allowing a microphone case main body to function as an acoustic tube, reducing a weight of the microphone, and suppressing leakage of sound waves from an inside of the acoustic tube to an outside.

To solve the above-described problems, a narrow-angle directional microphone according to the present invention includes a unidirectional microphone unit having a front acoustic terminal and a rear acoustic terminal, and an acoustic tube microphone case with a distal end open and having the microphone unit built in a rear end, wherein the acoustic tube microphone case includes a microphone case main body made of a metal tube having a plurality of openings formed in a circumferential surface, and an acoustic resistance material formed in a rectangular sheet manner, being rounded into a cylindrical shape as the left and right ends are in contact and arranged along an inner peripheral surface of the microphone case main body, and a plurality of the acoustic resistance materials is layered, and at least the innermost acoustic resistance material applies a force in a developing direction with an elastic force of the innermost acoustic resistance material, and presses the outside acoustic resistance material against the inner peripheral surface of the microphone case main body.

Note that joint portions where both the right and left ends of the plurality of acoustic resistance materials are in contact are preferably arranged in a state of being mutually shifted in a peripheral direction of the microphone case main body, and are preferably arranged in positions not to overlap with the openings of the microphone case main body.

Further, it is desirable that the plurality of openings formed in the peripheral surface of the microphone case main body be provided along a peripheral direction of the microphone case main body at equal intervals, and that the joint portions where both the right and left ends of the plurality of acoustic resistance materials are in contact be arranged in positions not to overlap with the openings of the microphone case main body, and in mutually facing positions along the peripheral direction of the microphone case main body.

Further, it is desirable that at least one of the plurality of acoustic resistance materials are formed of a conductive material.

Further, it is desirable that at least one of the plurality of acoustic resistance materials have a different acoustic resistance per unit area from that of another acoustic resistance material.

According to the narrow-angle directional microphone of the present invention, the plurality of sheet-like acoustic resistance materials are configured to be arranged to overlap on the inner peripheral surface of the microphone case main body, and to function as an acoustic tube. Accordingly, the narrow-angle directional microphone can substantially reduce the weight than conventional ones. Further, the plurality of acoustic resistance materials can be easily closely attached to the inner surface side of the case without using an adhesive when the acoustic resistance materials are arranged in the microphone case main body.

Further, in the acoustic resistance materials, the joint portions of the respective right and left end portions are arranged in a shifted manner. Because the innermost acoustic resistance material has elasticity, this elasticity applies a force to the developing direction, and the outside acoustic resistance material (closer to the inner surface of the case) is pressed against the inner surface of the microphone case main body, and is closely attached.

Accordingly, excellent narrow-angle directivity can be obtained without leakage of sound waves from the joint portions of the acoustic resistance materials to the outside.

To solve the above-described problems, a method of manufacturing a narrow-angle directional microphone according the present invention includes the steps of: providing a plurality of openings in a peripheral surface of a metal tube, and forming a microphone case main body, cylindrically rounding an acoustic resistance material formed in a rectangular sheet manner such that both right and left ends of the acoustic resistance material are mutually in contact, inserting the acoustic resistance material into the microphone case main body, and arranging the acoustic resistance material along an inner peripheral surface of the microphone case main body, and further cylindrically rounding another acoustic resistance material such that both right and left ends of the another acoustic resistance material are mutually in contact, inserting the another acoustic resistance material into the microphone case main body, and arranging the another acoustic resistance material along the inner peripheral surface of the microphone case main body, wherein, in the arranging the another acoustic resistance material along the inner peripheral surface of the microphone case main body, at least the innermost acoustic resistance material presses the outside acoustic resistance material against the inner peripheral surface of the microphone case main body by applying a force in a developing direction by an elastic force of the innermost acoustic resistance material.

Note that, in the arranging the acoustic resistance material along an inner peripheral surface of the microphone case main body, a joint portion of both the right and left ends of the acoustic resistance material is arranged not to overlap with the opening of the microphone case main body, and in a position shifted from the joint portion of another acoustic resistance material.

Further, in the arranging the acoustic resistance material along an inner peripheral surface of the microphone case main body, at least one acoustic resistance material is formed of a conductive material.

Further, in the arranging the acoustic resistance material along an inner peripheral surface of the microphone case main body, at least one acoustic resistance material has a different acoustic resistance per unit area from the another acoustic resistance material.

According to the method of manufacturing the narrow-angle directional microphone of the present invention, the plurality of sheet-like acoustic resistance materials is configured to overlap on the inner peripheral surface of the microphone case main body, and to function as an acoustic tube. Accordingly, the narrow-angle directional microphone can substantially reduce the weight than conventional ones. Further, the plurality of acoustic resistance materials can be easily closely attached to the inner surface side of the case without using an adhesive when the acoustic resistance materials are arranged in the microphone case main body.

Further, in the acoustic resistance materials, the joint portions of the respective right and left end portions are arranged in a shifted manner. Because the innermost acoustic resistance material has elasticity, this elasticity applies a force to the developing direction, and the outside acoustic resistance material (closer to the inner surface of the case) is pressed against the inner surface of the microphone case main body, and is closely attached.

Accordingly, excellent narrow-angle directivity can be obtained without leakage of sound waves from the joint portions of the acoustic resistance materials to the outside.

DESCRIPTION OF THE PREFERRED EMBODIMENTS

Figure 1:
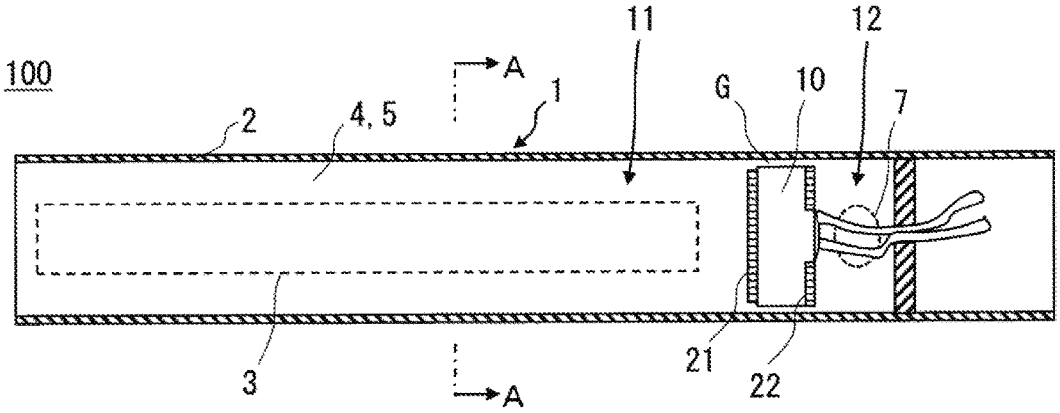
FIG. 1 is a sectional view in a longitudinal direction of a narrow-angle directional microphone according to the present invention.
Figure 2:
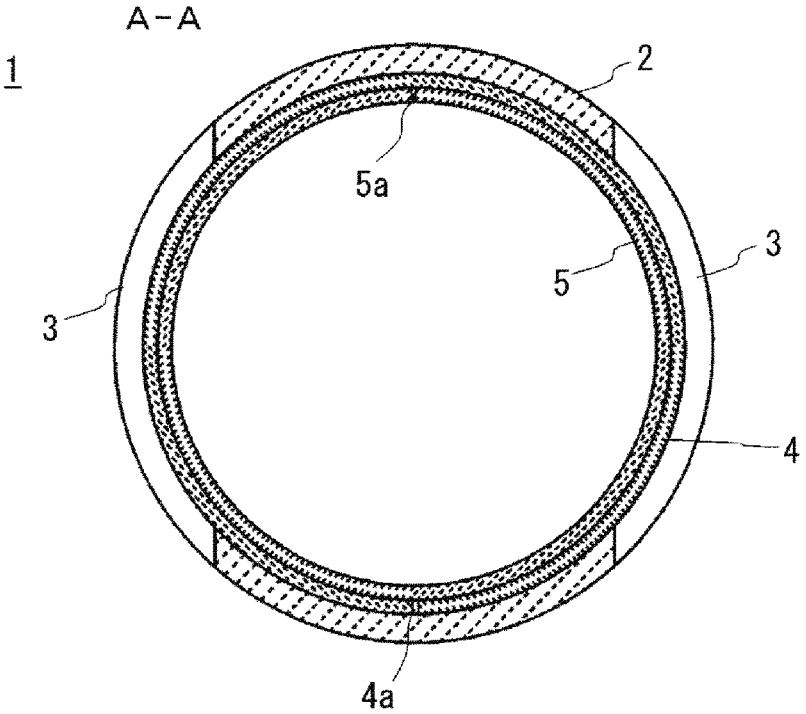
FIG. 2 is an A-A arrow sectional view of the narrow-angle directional microphone of FIG. 1, and a sectional view in a short direction of an acoustic tube microphone case included in the narrow-angle directional microphone.

Hereinafter, embodiments of the present invention will be described based on the drawings. FIG. 1 is a sectional view of a narrow-angle directional microphone according to the present invention in a longitudinal direction. FIG. 2 is an A-A arrow sectional view of the narrow-angle directional microphone of FIG. 1, and is a sectional view of an acoustic tube microphone case (a member serving two purposes including an acoustic tube and a microphone case in the present embodiment) included in the narrow-angle directional microphone in a short direction.

A narrow-angle directional microphone 100 illustrated in FIG. 1 accommodates a unidirectional microphone unit 10 in a rear end side of an interior of an acoustic tube microphone case 1. The interior of the acoustic tube microphone case 1, which functions as an acoustic tube, is divided into a front acoustic capacity chamber 11 and a rear acoustic capacity chamber 12 by the microphone unit 10. Note that slit-like openings 3 are formed in a front side of the acoustic tube microphone case 1. Acoustic resistance materials 4 and 5 are arranged to overlap to be closely attached to an inside of the acoustic tube microphone case. Accordingly, the openings 3 are blocked with the acoustic resistance materials 4 and 5.

A front acoustic terminal 21 is provided on one surface (a left-side surface in FIG. 1) of the microphone unit 10, and a rear acoustic terminal 22 is provided on the other surface (a right-side surface in FIG. 1). A sound wave introduction port 7 for the rear acoustic terminal 22 is drilled in the rear acoustic capacity chamber 12 of the acoustic tube microphone case 1. Note that this sound wave introduction port 7 is also blocked with the acoustic resistance materials 4 and 5.

Further, in this case, an outer diameter of the microphone unit 10 is smaller than an inner diameter of the acoustic tube microphone case 1. That is, a predetermined gap G is provided between an outer peripheral surface of the microphone unit 10 and an inner peripheral surface of the acoustic tube microphone case 1 (an inner peripheral surface of the acoustic resistance material 5), and the front acoustic terminal 21 and the rear acoustic terminal 22 of the microphone unit 10 are acoustically connected with the gap G.

As described above, the rear acoustic terminal 22 of the microphone unit 10 is led to a free sound field through the sound wave introduction port 7, and is also acoustically connected to the front acoustic terminal 21 through the gap G. Therefore, a distance between the acoustic terminals in a low frequency range is mainly subject to a distance between the acoustic terminals 21 and 22 of the microphone unit 10. Accordingly, an influence of wind noise and a proximity effect are reduced.

As illustrated in FIG. 2, the acoustic tube microphone case 1 includes a microphone case main body 2 formed in a cylindrical manner, the first acoustic resistance material 4 closely attached to an inner peripheral surface of the microphone case main body 2, and the second acoustic resistance material 5 closely attached to an inner peripheral surface of the first acoustic resistance material 4 and having elasticity. The first acoustic resistance material 4 is made of non-woven fabric or a resin, for example, and the second acoustic resistance material 5 is made of a fine metal mesh, for example.

A plurality of the acoustic openings 3 is provided on a peripheral surface of the microphone case main body 2. The first acoustic resistance material 4 is exposed through the acoustic openings 3.

Further, the first acoustic resistance material 4 is made of a sheet-like acoustic resistance material, and is cylindrically rounded and accommodated in the microphone case main body 2. At this time, a cylinder of the acoustic resistance material is formed in a state where both right and left ends are mutually in contact, and the size of the sheet of the acoustic resistance material is determined in advance such that an outer diameter of the cylinder of the first acoustic resistance material 4 accords with an inner diameter of the microphone case main body 2.

Further, the second acoustic resistance material 5 is formed by cylindrically rounding a sheet-like acoustic resistance material having elasticity. The second acoustic resistance material 5 is cylindrically deformed such that both right and left ends of thereof mutually come into contact. The second acoustic resistance material 5 is formed in advance such that an outer diameter of the second acoustic resistance material 5 accords with an inner diameter of the cylindrical first acoustic resistance material 4.

The first acoustic resistance material 4 and the second acoustic resistance material 5 are made of different acoustic resistance materials, and a ratio of the acoustic resistances per unit area is about 1:10. The acoustic resistances of the acoustic resistance materials 4 and 5 overlapping with each other as described above are different, so that adjustment of the acoustic resistance per unit length of the acoustic tube becomes easy. For example, an acoustic resistance value is coarsely adjusted with an acoustic resistance material having low acoustic resistance density, for example, and an acoustic resistance material having high acoustic adjustment density is combined therewith, so that the acoustic resistance value can be finely set.

Further, in the first acoustic resistance material 4 and the second acoustic resistance material 5 overlapping with each other in the microphone case main body 2, when positions of a joint portion 4*a* of the first acoustic resistance material 4 and a joint portion 5*a* of the second acoustic resistance material 5 are the same, a gap is formed in the joint portions 4*a* and 5*a*. Consequently, an inside and an outside of the acoustic tube are acoustically connected. At this time, an acoustic resistance value of the gap between the joint portions 4*a* and 5*a* is extremely lower than those of the acoustic resistance materials 4 and 5. Therefore, sound waves pass through the gap, and do not pass through the acoustic resistance materials 4 and 5. A microphone using the acoustic tube in this state does not exhibit narrow-angle directivity.

Therefore, in the present embodiment, the position of the joint portion 4*a* of right and left end portions of the first acoustic resistance material 4 and the position of the joint portion 5*a* of right and left end portions of the second acoustic resistance material 5 are in mutually shifted state (the positions are mutually facing positions along a peripheral direction of the case, and most preferably in a state of being shifted by 180°), as illustrated. Further, the joint portions 4*a* and 5*a* are arranged not to overlap with the positions of the acoustic openings 3 formed in the microphone case main body 2. That is, the joint portions 4*a* and 5*a* are arranged in positions where the joint portions are not exposed.

As described above, the position of the joint portion 4*a* of the first acoustic resistance material 4 and the position of the joint portion 5*a* of the second acoustic resistance material 5 are the mutually shifted positions, so that a thin air layer between the first acoustic resistance material 4 and the microphone case main body 2 is pressed by an elastic force of the second acoustic resistance material 5. Accordingly, near the joint portion 4*a*, at least, of the first acoustic resistance material 4, the first acoustic resistance material 4 is in a closely attached state from both upper and lower sides by the second acoustic resistance material 5 and the microphone case main body 2, and leakage of sound waves from an interior of the acoustic tube is prevented.

Further, even if the thin air layer is formed between the first acoustic resistance material 4 and the second acoustic resistance material 5, the acoustic resistance value due to at least the gap of the joint portion 4*a* of the first acoustic resistance material 4 does not decrease, as described above. Therefore, sound waves do not leak.

Next, a method of manufacturing the acoustic tube microphone case 1 included in the narrow-angle directional microphone of the present invention will be described with reference to FIGS. 3A to 3D. FIGS. 3A to 3D are sectional views illustrating a process of manufacturing the acoustic tube microphone case 1 of FIG. 2.

First, The microphone case main body 2 is formed by providing a plurality of openings in the peripheral surface of the metal tube along the peripheral direction at equal intervals.

Figure 3A:
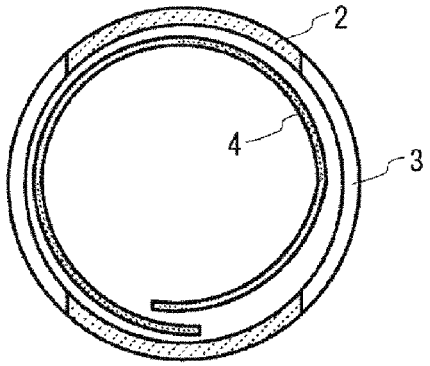
FIGS. 3A to 3D are sectional views illustrating a process of manufacturing the acoustic tube microphone case of FIG. 2.

Next, as illustrated in FIG. 3A, the sheet-like first acoustic resistance material 4 which is cylindrically rounded is inserted into the microphone case main body 2.

Figure 3B:
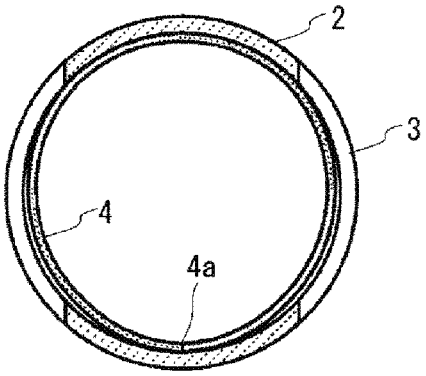

Further, as illustrated in FIG. 3B, both the right and left ends of the first acoustic resistance material 4 are put together, and the linear joint portion 4*a* is formed along an axis of the microphone case main body 2. At this time, the position of the joint portion 4*a* is arranged not to overlap with the opening 3 in the microphone case main body 2. Further, at this time, the cylindrically rounded first acoustic resistance material 4 is developed by an own restoring force, and is closely attached to the inner peripheral surface of the microphone case main body 2. Therefore, an adhesive is not necessary. Note that, in this state, the gap (thin air layer) is formed between the first acoustic resistance material 4 and the microphone case main body 2, as illustrated.

Figure 3C:
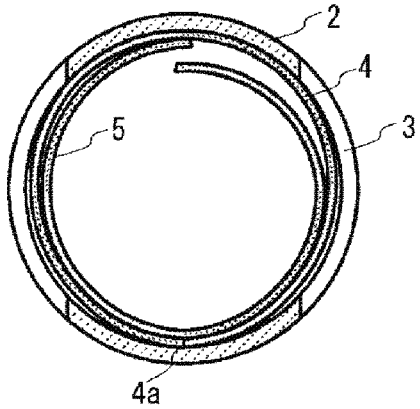

Next, as illustrated in FIG. 3C, the cylindrically rounded second acoustic resistance material 5 is inserted into the microphone case main body 2.

Figure 3D:
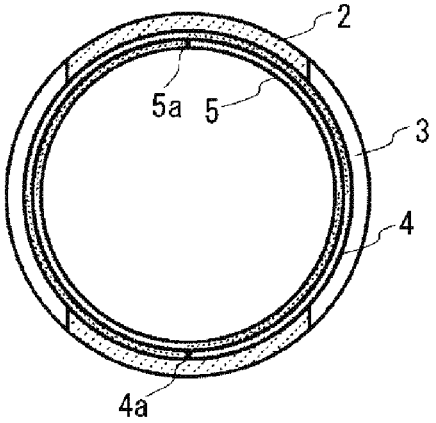

Next, as illustrated in FIG. 3D, the position of the joint portion 5*a* of the second acoustic resistance material 5 is arranged in the position shifted by about 180° from the position of the joint portion 4*a* of the first acoustic resistance material 4, and is arranged not to overlap with the opening 3 in the microphone case main body 2.

Here, the second acoustic resistance material 5 is deformed (restored) in a developing direction by an elastic force thereof. Therefore, the second acoustic resistance material 5 presses the inner peripheral surface of the first acoustic resistance material 4 against the inner surface of the microphone case main body 2 and closely attaches the inner peripheral surface of the first acoustic resistance material 4 to the inner surface of the microphone case main body 2. Accordingly, the first acoustic resistance material 4 is pressed against the inner peripheral surface of the microphone case main body 2, and the thin air layer formed between the first acoustic resistance material 4 and the microphone case main body 2 disappears. Further, the joint portion 4*a* of the first acoustic resistance material 4 is closely attached to the microphone case main body 2 and to the second acoustic resistance material 5, which are in the up and down directions of the joint portion 4*a*. Therefore, the leakage of sound waves through the joint portion 4*a* is prevented.

As described above, according to the embodiment of the present invention, the two acoustic resistance materials 4 and 5 are configured to overlap on the inner peripheral surface of the microphone case main body 2, and to function as an acoustic tube. Such a configuration can substantially reduce the weight of the narrow-angle directional microphone than conventional ones. Further, the first and second acoustic resistance materials 4 and 5 can be easily closely attached to the inner surface side of the case without using an adhesive, when the first and second acoustic resistance materials 4 and 5 are arranged in the microphone case main body 2.

Further, in the acoustic resistance materials 4 and 5, the joint portions of the respective right and left end portions are arranged in a shifted manner (desirably 180°). The innermost acoustic resistance material 5 has elasticity, and thus applies a force in the direction into which the acoustic resistance material 5 is developed (restored in a sheet manner), and presses the acoustic resistance material 4 against the inner surface of the microphone case main body 2 and closely attaches the acoustic resistance material 4 to the inner surface.

Accordingly, the sound waves are not leaked through the joint portions 4*a* and 5*a* of the acoustic resistance materials 4 and 5 to an outside, and the narrow-angle directional microphone in the present embodiment can obtain excellent narrow-angle directivity.

Note that, in the above-described embodiment, the two sheet-like acoustic resistance materials 4 and 5 are closely attached to the inner peripheral surface of the microphone case main body 2. However, the number of the acoustic resistance materials may just be at least two, and is not limited as long as the number is two or more.

Figure 4:
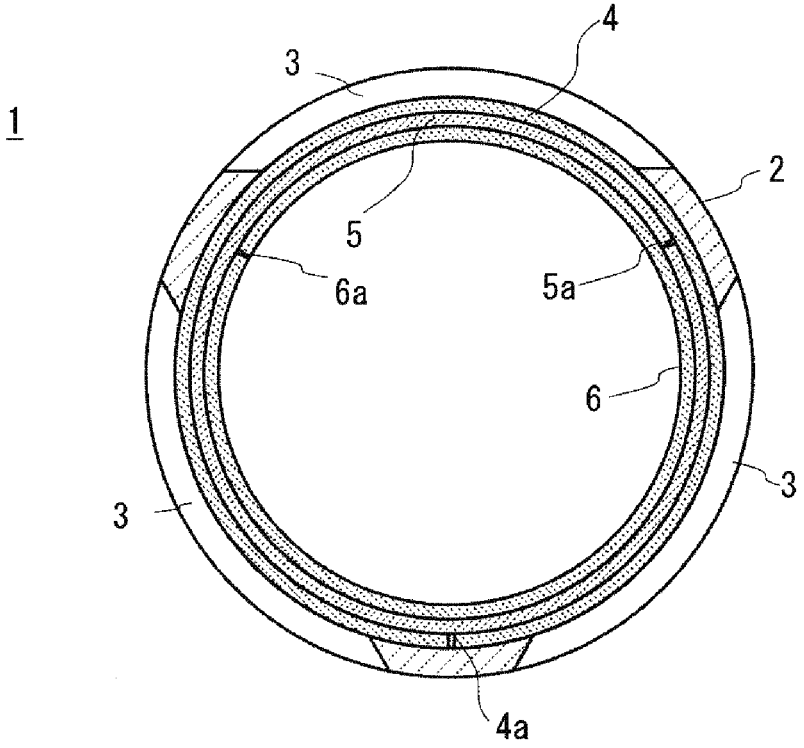
FIG. 4 is a sectional view illustrating a modification of the acoustic tube microphone case of FIG. 2.

For example, as illustrated in FIG. 4, three acoustic resistance materials 4, 5, and 6 may be closely attached to overlap on the inner peripheral surface of the microphone case main body 2. In that case, the microphone case main body 2 includes the openings 3 in three places in the peripheral direction at equal intervals, as illustrated, and joint portions 4*a*, 5*a*, and 6*a* of the acoustic resistance materials 4, 5, and 6 may just be arranged not to overlap with the positions of the openings 3 respectively.

The narrow-angle directional microphone according to the present invention will be further described based on examples. In the present example, the narrow-angle directional microphone including the acoustic tube microphone case described in the above embodiment is manufactured, and characteristics thereof are verified by performing an experiment to measure the characteristics.

Figure 5A:
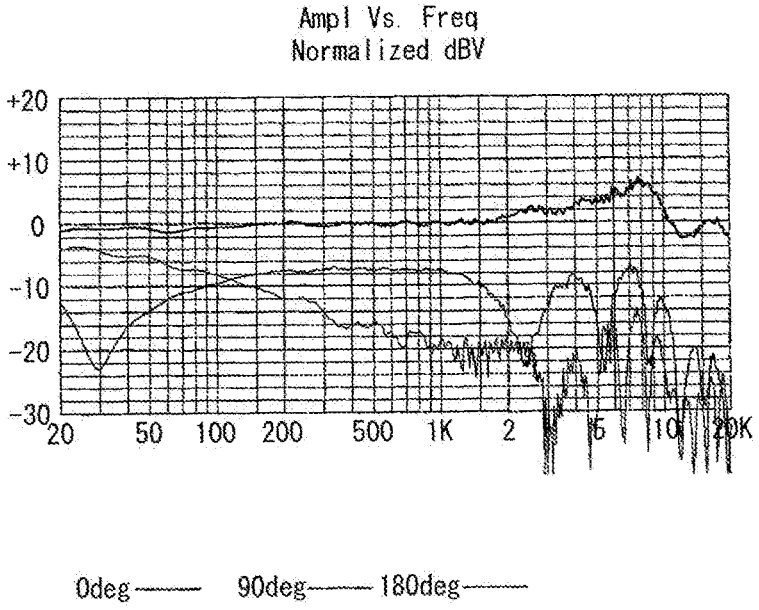
FIG. 5A is a graph illustrating a result of Example 1.

In Example 1, the microphone unit is attached to the rear end portion of the acoustic tube microphone case as illustrated in FIG. 1, and a result of measurement of directivity characteristics thereof is illustrated. FIG. 5A is directivity characteristic graphs in directions of 0 degrees, 90 degrees, and 180 degrees, which have been obtained by the measurement. Further, FIG. 5B is a polar pattern thereof.

Figure 5B:
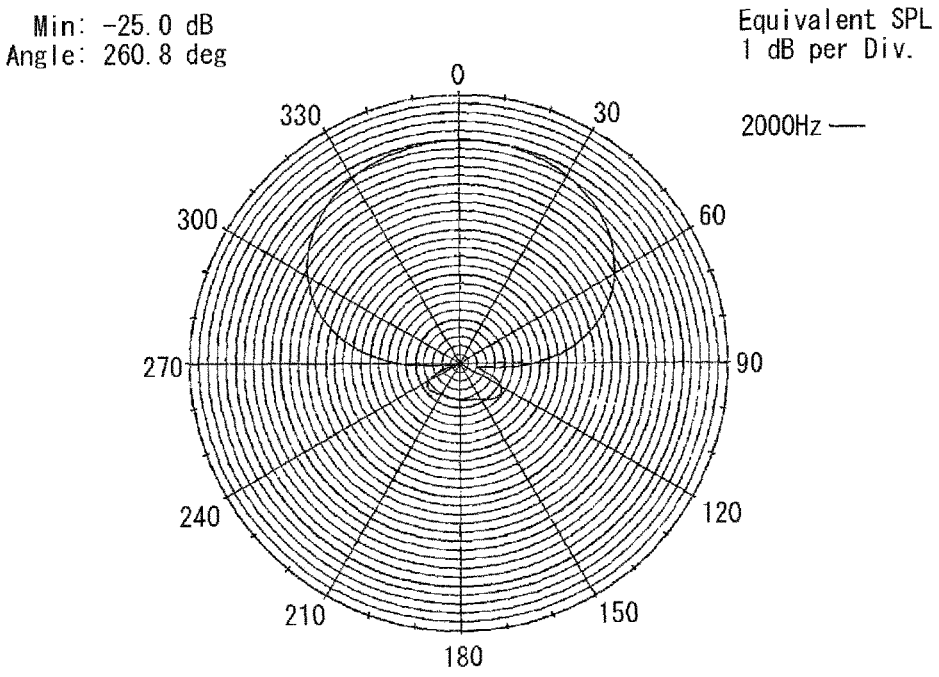
FIG. 5B is a polar pattern thereof.

As illustrated in FIGS. 5A and 5B, it has been confirmed that the directivity of the narrow-angle directional microphone of the present embodiment is especially favorable at 0 degrees, and has narrow-angle directional characteristics.

Comparative Example 1 measures directivity characteristics of a microphone in which an acoustic resistance material is not stuck to an inner surface of a microphone case main body.

Figure 6A:
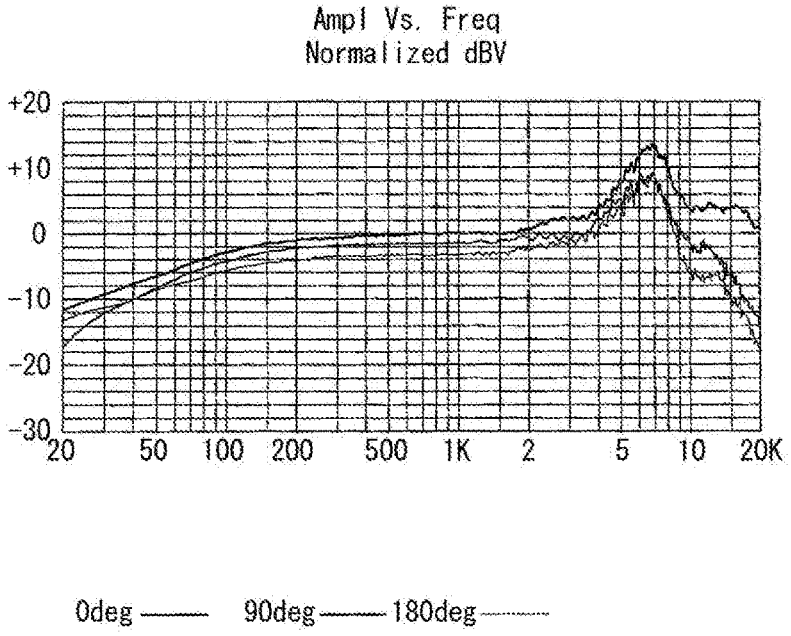
FIG. 6A is a graph illustrating a result of Comparative Example 1.
Figure 6B:
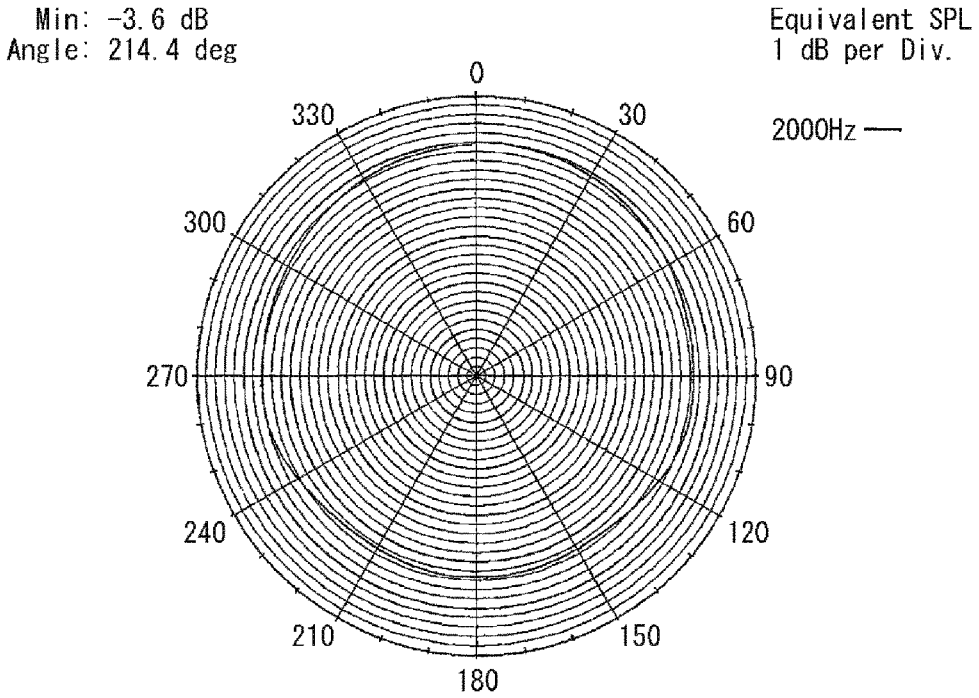
FIG. 6B is a polar pattern thereof.

FIG. 6A is a directivity characteristic graph in directions of 0 degrees, 90 degrees, and 180 degrees, which have been obtained by measurement of Comparative Example 1. Further, FIG. 6B is a polar pattern thereof. As illustrated in FIGS. 6A and 6B, non-directional of the microphone of Comparative Example 1 is obtained, as a result.

Comparative Example 2 measures directivity characteristics of a microphone in which one sheet of metal mesh is stuck to an inner peripheral surface of a microphone case main body as an acoustic resistance material, like a conventional case.

Figure 7A:
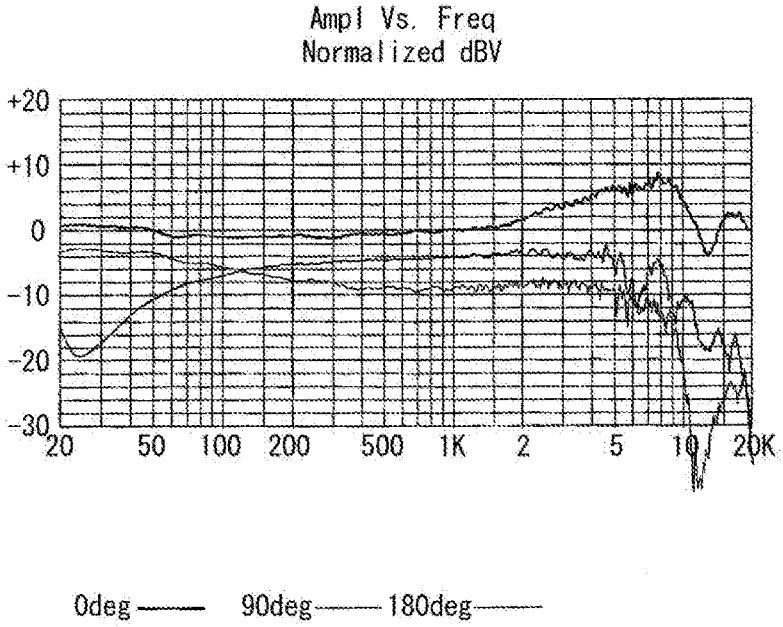
FIG. 7A is a graph illustrating a result of Comparative Example 2.
Figure 7B:
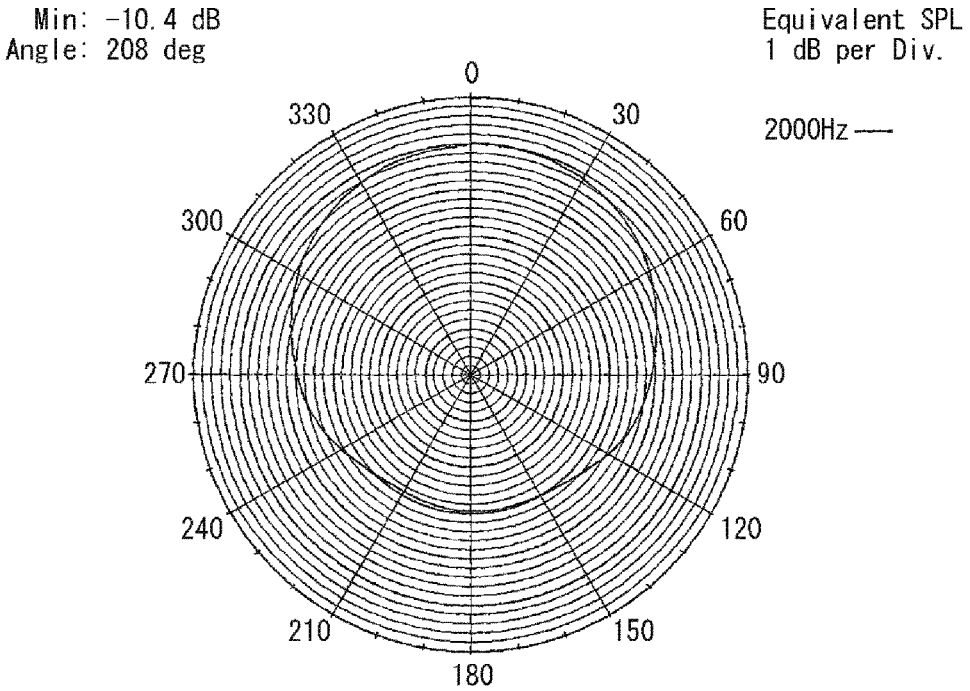
FIG. 7B is a polar pattern thereof.
Figure 8:
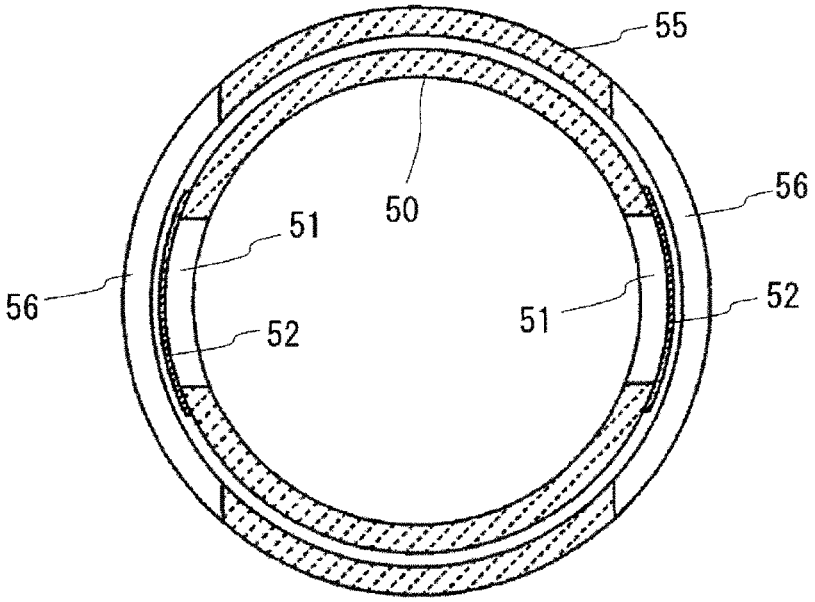
Fig. 8 Prior Art
FIG. 8 is a sectional view of a microphone accommodated in a microphone case of a conventional acoustic tube.
Figure 9:
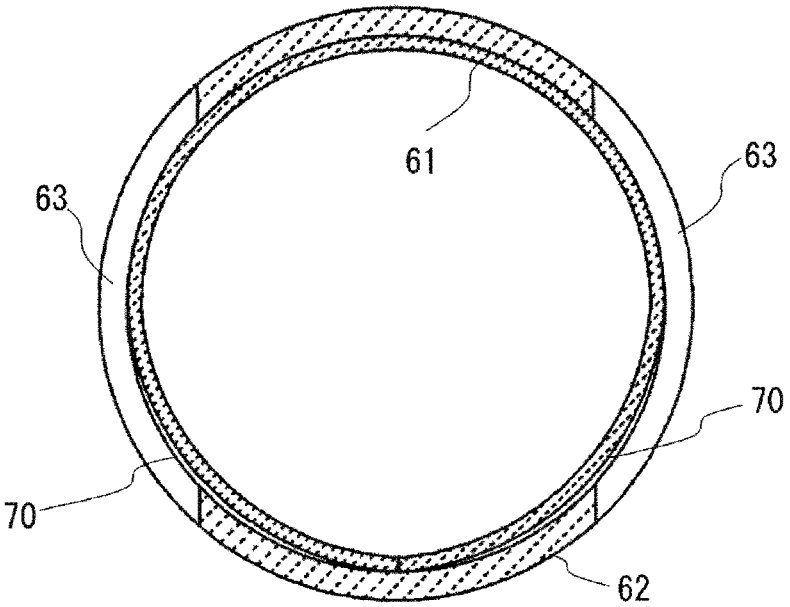
Fig. 9 Prior Art
FIG. 9 is a sectional view of a microphone in which one sheet of acoustic resistance material is stuck to an inside of a conventional microphone case.

FIG. 7A is a directivity characteristic graph in directions of 0 degrees, 90 degrees, and 180 degrees, which have been obtained by measurement of Comparative Example 2. Further, FIG. 7B is a polar pattern thereof. As illustrated in FIGS. 7A and 7B, Comparative Example 2 exhibits unidirectivity, but the directivity is not narrow as Example 1.

From the results of the above examples, according to the present invention, at least the acoustic resistance materials are doubly stuck to the inner peripheral surface of the microphone case main body, and the positions of the joint portions of the respective acoustic resistance materials are mutually shifted and the positions of the joint portions are arranged to avoid the positions of the openings of the microphone case main body. Therefore, it has been confirmed that the leakage of sound waves from the inside of the acoustic tube to an outside is suppressed, and the decrease in the acoustic resistance value is prevented, whereby excellent narrow-angle directivity can be obtained.

What is claimed is:

1. A narrow-angle directional microphone comprising:

a unidirectional microphone unit having a front acoustic terminal and a rear acoustic terminal; and an acoustic tube microphone case with an open distal end, in which the microphone unit is stored in a rear end, wherein the acoustic tube microphone case includes:

a microphone case main body made of a metal tube having a plurality of openings formed in a peripheral surface, and a plurality of acoustic resistance materials arranged in the microphone case main body, and including an innermost acoustic resistance material and an outer acoustic resistance material arranged on the innermost acoustic resistance material to be sandwiched between the microphone case main body and the innermost acoustic resistance material, each being formed in a rectangular sheet manner, rounded cylindrically to make two ends come in contact with each other, and arranged along an inner peripheral surface of the microphone case main body, the innermost acoustic resistance material annularly applies a force in a developing direction with an elastic force of the innermost acoustic resistance material, and presses the one outer acoustic resistance material toward the inner peripheral surface of the microphone case main body such that an air layer is not formed between the microphone case main body and the outer acoustic resistance material, and the plurality of acoustic resistance materials includes joint portions where two ends of each of the plurality of acoustic resistance materials are contacted, the joint portions being arranged at positions to be mutually shifted in a peripheral direction of the microphone case main body and not to overlap with the plurality of openings of the microphone case main body.

2. The narrow-angle directional microphone according to claim 1, wherein the plurality of openings formed in the peripheral surface of the microphone case main body is provided along the peripheral direction of the microphone case main body at equal intervals, and the joint portions are arranged at mutually facing positions along the peripheral direction of the microphone case main body.

3. The narrow-angle directional microphone according to claim 1, wherein at least one of the plurality of acoustic resistance materials is formed of a conductive material.

4. The narrow-angle directional microphone according to claim 1, wherein at least one of the plurality of acoustic resistance materials has a different acoustic resistance per unit area from another of the plurality of acoustic resistance materials.

5. A method of manufacturing the narrow-angle directional microphone according to claim 1, the method comprising steps of:

providing the plurality of openings in the peripheral surface of the metal tube to form the microphone case main body;

cylindrically rounding at least one outer acoustic resistance material formed in the rectangular sheet manner such that the two ends of the outer acoustic resistance material are mutually contacted;

inserting the outer acoustic resistance material into the microphone case main body, and arranging the outer acoustic resistance material along the inner peripheral surface of the microphone case main body;

further cylindrically rounding the innermost acoustic resistance material such that the two ends of the innermost acoustic resistance material are mutually contacted; and inserting the innermost acoustic resistance material into the microphone case main body, and arranging the innermost acoustic resistance material along the inner peripheral surface of the microphone case main body to press the outer acoustic resistance material toward the inner peripheral surface of the microphone case main body by annularly applying the force in the developing direction with the elastic force of the innermost acoustic resistance material such that the air layer is not formed between the microphone case main body and the at least one outer acoustic resistance material, wherein in the step of arranging the outer acoustic resistance material, the joint portion of the outer acoustic resistance material is arranged at the position not to overlap with the plurality of openings of the microphone case main body, and in the step of arranging the innermost acoustic resistance material, the joint portion of the innermost acoustic resistance material is arranged at the position to be shifted from the joint portion of the outer acoustic resistance material in the peripheral direction of the microphone case main body and not to overlap with the plurality of openings of the microphone case main body.

6. The method of manufacturing the narrow-angle directional microphone according to claim 5, wherein at least one of the plurality of acoustic resistance materials is formed of a conductive material.

7. The method of manufacturing the narrow-angle directional microphone according to claim 5, wherein at least one of the plurality of acoustic resistance materials has a different acoustic resistance per unit area from another of the plurality of acoustic resistance materials.

8. The narrow-angle directional microphone according to claim 1, wherein the outer acoustic resistance material is formed of a non-woven fabric or a resin, and the innermost acoustic resistance material is formed of a fine metal mesh, and when the outer acoustic resistance material and the innermost resistance material are arranged in the microphone case main body, the outer acoustic resistance material has an outer diameter substantially matched with an inner diameter of the microphone case main body, and the innermost acoustic resistance material has an outer diameter substantially matched with an inner diameter of the outer acoustic resistance material.

* * * * *